US009328924B2

(12) United States Patent
Condevaux et al.

(10) Patent No.: US 9,328,924 B2
(45) Date of Patent: May 3, 2016

(54) COMBUSTION SYSTEM

(71) Applicant: WILLIAMS INTERNATIONAL, CO., L.L.C., Walled Lake, MI (US)

(72) Inventors: Jamey J. Condevaux, Livonia, MI (US); Lisa M. Simpkins, Novi, MI (US); John Sordyl, Northville, MI (US)

(73) Assignee: WILLIAMS INTERNATIONAL CO., LLC, Walled Lake, MI (US)

( * ) Notice: Subject to any disclaimer, the term of this patent is extended or adjusted under 35 U.S.C. 154(b) by 245 days.

(21) Appl. No.: 14/148,695

(22) Filed: Jan. 6, 2014

(65) Prior Publication Data

US 2014/0116055 A1 May 1, 2014

Related U.S. Application Data

(62) Division of application No. 12/710,764, filed on Feb. 23, 2010, now Pat. No. 8,640,464.

(60) Provisional application No. 61/154,570, filed on Feb. 23, 2009.

(51) Int. Cl.
*F23R 3/16* (2006.01)
*F23R 3/06* (2006.01)
(Continued)

(52) U.S. Cl.
CPC ... *F23R 3/16* (2013.01); *F23R 3/06* (2013.01); *F23R 3/343* (2013.01); *F23R 3/38* (2013.01);
(Continued)

(58) Field of Classification Search
CPC ..... F23R 3/16; F23R 3/06; F23R 3/343; F23R 3/38; F23R 3/50; F23R 3/52; F23R 2900/00015; F23R 2900/03041; F23R 2900/03282
USPC ..... 60/732, 752, 740, 756, 758, 760, 776, 60/745
See application file for complete search history.

(56) References Cited

U.S. PATENT DOCUMENTS 2,526,410 A 10/1950 Price
2,560,207 A 7/1951 Berggren et al.
(Continued)

FOREIGN PATENT DOCUMENTS

DE 1062066 B 7/1959
EP 0486226 A1 5/1992
(Continued)

OTHER PUBLICATIONS

International Search Report and Written Opinion of the International Searching Authority in International Application No. PCT/US2010/025073, Oct. 15, 2012, 12 pages.
(Continued)

*Primary Examiner* — Steven Sutherland
(74) *Attorney, Agent, or Firm* — Raggio & Dinnin, P.C.

(57) ABSTRACT

A first orifice on a first inner surface of a first annular zone of a forward-bounded annular combustor provides for injecting air forward and radially outwards thereinto, from a location aft of a fuel slinger/injector. A radial dimension of a first outer surface of the first annular zone exceeds that of a corresponding first inner surface. A radial dimension of a second outer surface of a second annular zone of the annular combustor—aft of the first annular zone—exceeds that of a corresponding second inner surface. The first and second outer surfaces, and the first and second inner surfaces, are respectively coupled by transitional outer and inner surfaces of an annular transition zone located therebetween. The radial dimensions of the transitional outer and inner surfaces at the junctions with the corresponding second surfaces exceed the corresponding radial dimensions at the junctions with the corresponding first surfaces.

32 Claims, 9 Drawing Sheets

(51) Int. Cl.

| | |
|---|---|
| ***F23R 3/34*** | (2006.01) |
| ***F23R 3/38*** | (2006.01) |
| ***F23R 3/50*** | (2006.01) |
| ***F23R 3/52*** | (2006.01) |

(52) U.S. Cl.
CPC ... *F23R 3/50* (2013.01); *F23R 3/52* (2013.01); *F23R 2900/00015* (2013.01); *F23R 2900/03041* (2013.01); *F23R 2900/03282* (2013.01)

(56) References Cited

U.S. PATENT DOCUMENTS

| | | | | |
|---|---|---|---|---|
| 2,560,223 | A | 7/1951 | Hanzalek | |
| 2,575,682 | A | 11/1951 | Price | |
| 2,611,241 | A | 9/1952 | Schulz | |
| 2,631,429 | A | 3/1953 | Jacklin, Jr. | |
| 2,827,759 | A | 3/1958 | Bruckmann | |
| 2,935,840 | A | 5/1960 | Schoppe | |
| 2,999,359 | A | 9/1961 | Murray | |
| 3,055,179 | A | 9/1962 | Lefebvre et al. | |
| 3,080,715 | A | 3/1963 | Lefebvre | |
| 3,088,281 | A | 5/1963 | Soltau et al. | |
| 3,134,229 | A | 5/1964 | Johnson | |
| 3,182,453 | A * | 5/1965 | Probert | F01D 9/023 415/177 |
| 3,333,414 | A | 8/1967 | Saintsbury | |
| 3,381,471 | A | 5/1968 | Szydiowski | |
| 3,603,082 | A | 9/1971 | Sneeden et al. | |
| 3,645,095 | A | 2/1972 | Melconian | |
| 3,820,324 | A | 6/1974 | Grindley et al. | |
| 3,869,864 | A | 3/1975 | Bunn | |
| 4,040,251 | A | 8/1977 | Heitmann et al. | |
| 4,098,073 | A | 7/1978 | Adkins et al. | |
| 4,185,458 | A | 1/1980 | Ernst | |
| 4,187,674 | A | 2/1980 | Richardson | |
| 4,203,285 | A | 5/1980 | Hanloser et al. | |
| 4,586,328 | A | 5/1986 | Howald | |
| 4,898,001 | A | 2/1990 | Kuroda et al. | |
| 4,996,838 | A | 3/1991 | Melconian | |
| 5,161,369 | A | 11/1992 | Williams | |
| 5,187,937 | A | 2/1993 | Stevens et al. | |
| 5,207,054 | A | 5/1993 | Rodgers et al. | |
| 5,265,425 | A | 11/1993 | Howell | |
| 5,289,686 | A | 3/1994 | Razdan et al. | |
| 5,307,637 | A * | 5/1994 | Stickles | F23R 3/002 60/756 |
| 5,323,602 | A | 6/1994 | Defever | |
| 5,406,799 | A | 4/1995 | Marshall | |
| 5,473,881 | A | 12/1995 | Kramnik et al. | |
| 5,490,380 | A | 2/1996 | Marshall | |
| 5,619,855 | A | 4/1997 | Burrus | |
| 5,636,510 | A | 6/1997 | Béer et al. | |
| 5,746,048 | A | 5/1998 | Shah | |
| 5,775,108 | A | 7/1998 | Ansart et al. | |
| 5,791,148 | A | 8/1998 | Burrus | |
| 5,857,339 | A | 1/1999 | Roquemore et al. | |
| 5,918,467 | A | 7/1999 | Kwan | |
| 6,119,459 | A | 9/2000 | Gomez et al. | |
| 6,148,617 | A | 11/2000 | Williams | |
| 6,286,298 | B1 | 9/2001 | Burrus et al. | |
| 6,286,317 | B1 | 9/2001 | Burrus et al. | |
| 6,295,801 | B1 | 10/2001 | Burrus et al. | |
| 6,497,103 | B2 | 12/2002 | Johnson et al. | |
| 6,530,223 | B1 | 3/2003 | Dodds et al. | |
| 6,540,162 | B1 | 4/2003 | Johnson et al. | |
| 6,640,545 | B2 | 11/2003 | Ruck et al. | |
| 6,736,338 | B2 | 5/2004 | Johnson et al. | |
| 6,820,424 | B2 | 11/2004 | Oechsle et al. | |
| 6,826,912 | B2 | 12/2004 | Levy et al. | |
| 6,851,263 | B2 | 2/2005 | Stumpf et al. | |
| 6,901,760 | B2 | 6/2005 | Dittmann et al. | |
| 6,951,108 | B2 | 10/2005 | Burrus et al. | |
| 6,955,053 | B1 | 10/2005 | Chen et al. | |
| 7,010,923 | B2 | 3/2006 | Mancini et al. | |
| 7,036,321 | B2 | 5/2006 | Dudebout et al. | |
| 7,086,854 | B2 | 8/2006 | Rakhmailov et al. | |
| 7,568,343 | B2 | 8/2009 | Harris et al. | |
| 2006/0107667 | A1 | 5/2006 | Haynes et al. | |
| 2006/0196164 | A1 | 9/2006 | Donohue | |
| 2007/0193248 | A1 * | 8/2007 | Bessagnet | F23R 3/06 60/39.01 |
| 2007/0234725 | A1 | 10/2007 | Critchley et al. | |
| 2007/0234733 | A1 * | 10/2007 | Harris | F01D 25/12 60/776 |
| 2007/0271926 | A1 | 11/2007 | Alkabie | |
| 2008/0041059 | A1 | 2/2008 | Teets | |
| 2008/0233525 | A1 | 9/2008 | Callas et al. | |
| 2008/0256924 | A1 | 10/2008 | Pederson et al. | |
| 2008/0271703 | A1 | 11/2008 | Armstrong et al. | |

FOREIGN PATENT DOCUMENTS

| | | | |
|---|---|---|---|
| EP | 1001222 | B1 | 1/2007 |
| GB | 686908 | A | 2/1953 |
| WO | 0111215 | A1 | 2/2001 |
| WO | 2010096817 | A2 | 8/2010 |

OTHER PUBLICATIONS

International Preliminary Report on Patentability in International Application No. PCT/US2010/025073, Jan. 22, 2013, 7 pages.

* cited by examiner

COMBUSTION SYSTEM

CROSS-REFERENCE TO RELATED APPLICATIONS

The instant application is a division of U.S. application Ser. No. 12/710,764 filed on 23 Feb. 2010, which claims the benefit of prior U.S. Provisional Application Ser. No. 61/154,570 filed on 23 Feb. 2009. Each of the above-identified applications is incorporated herein by reference.

DESCRIPTION OF EMBODIMENT(S)

Figure 1:
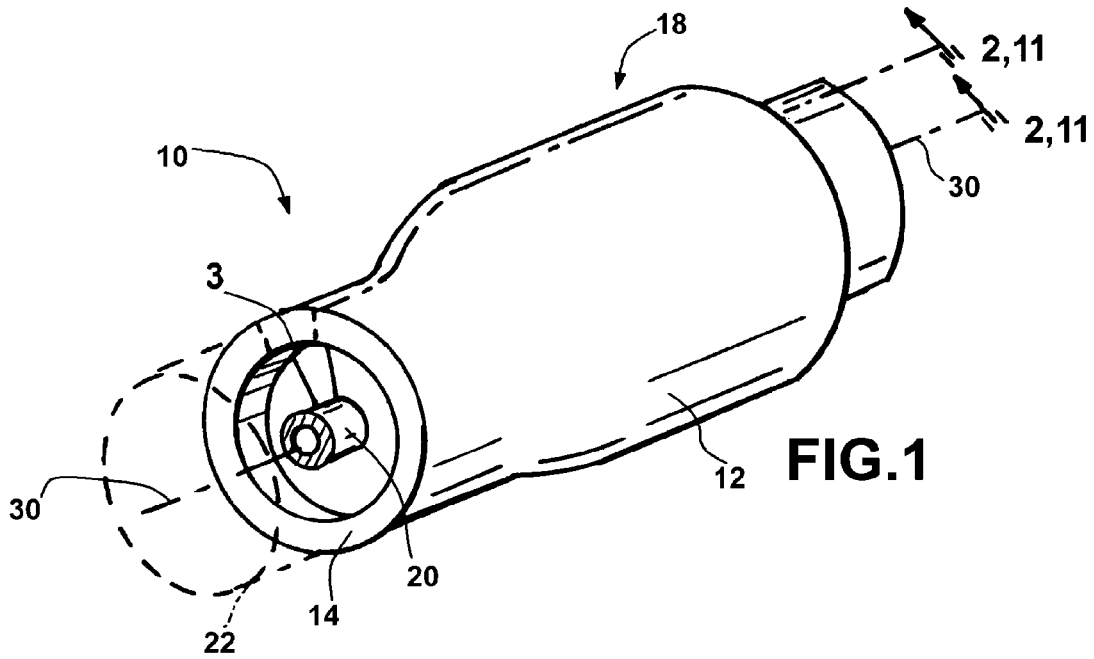
FIG. 1 illustrates an isometric view of a combustion system.
Figure 2:
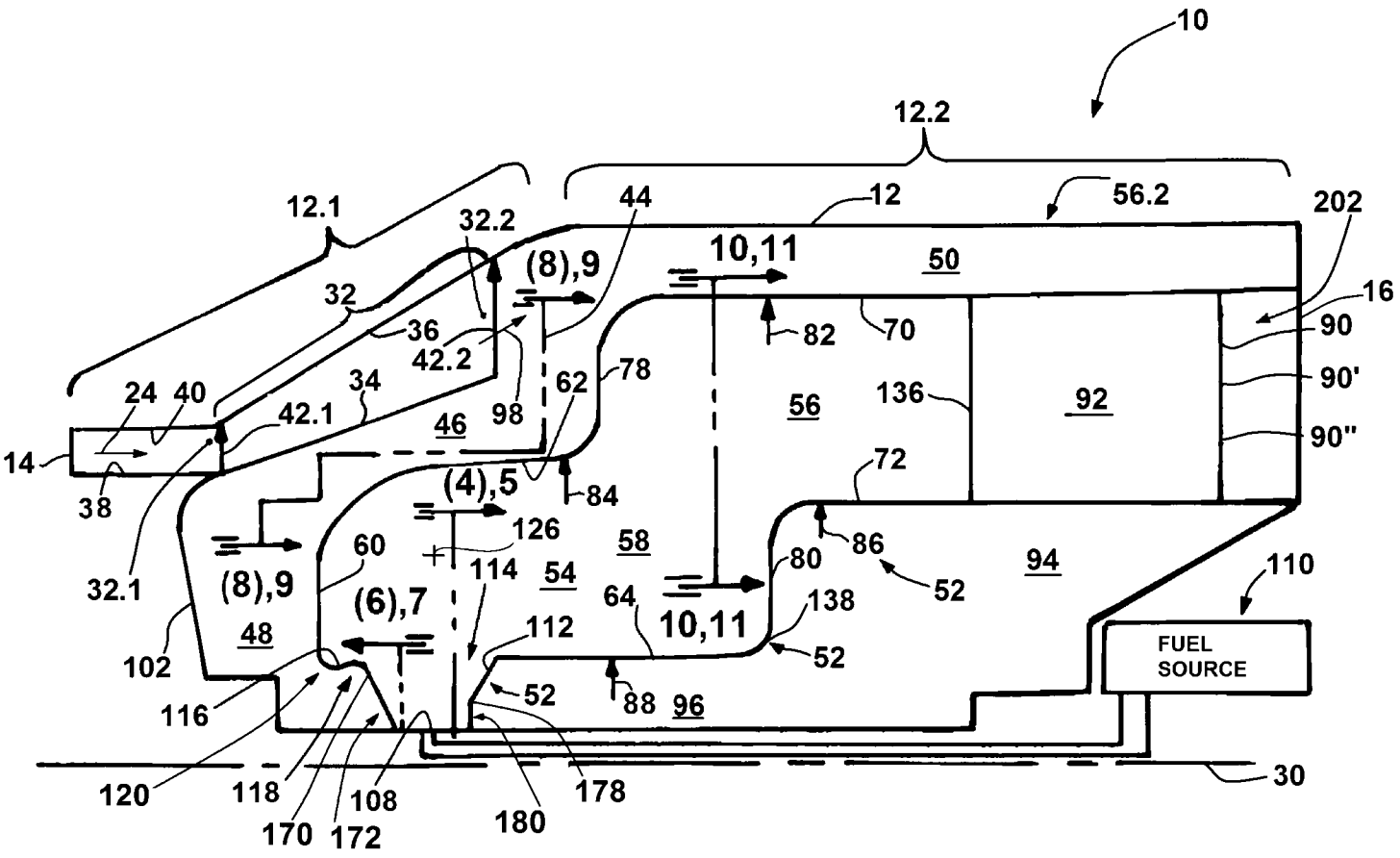
FIG. 2 illustrates a radial cross-section of the combustion system illustrated in FIG. 1.
Figure 3:
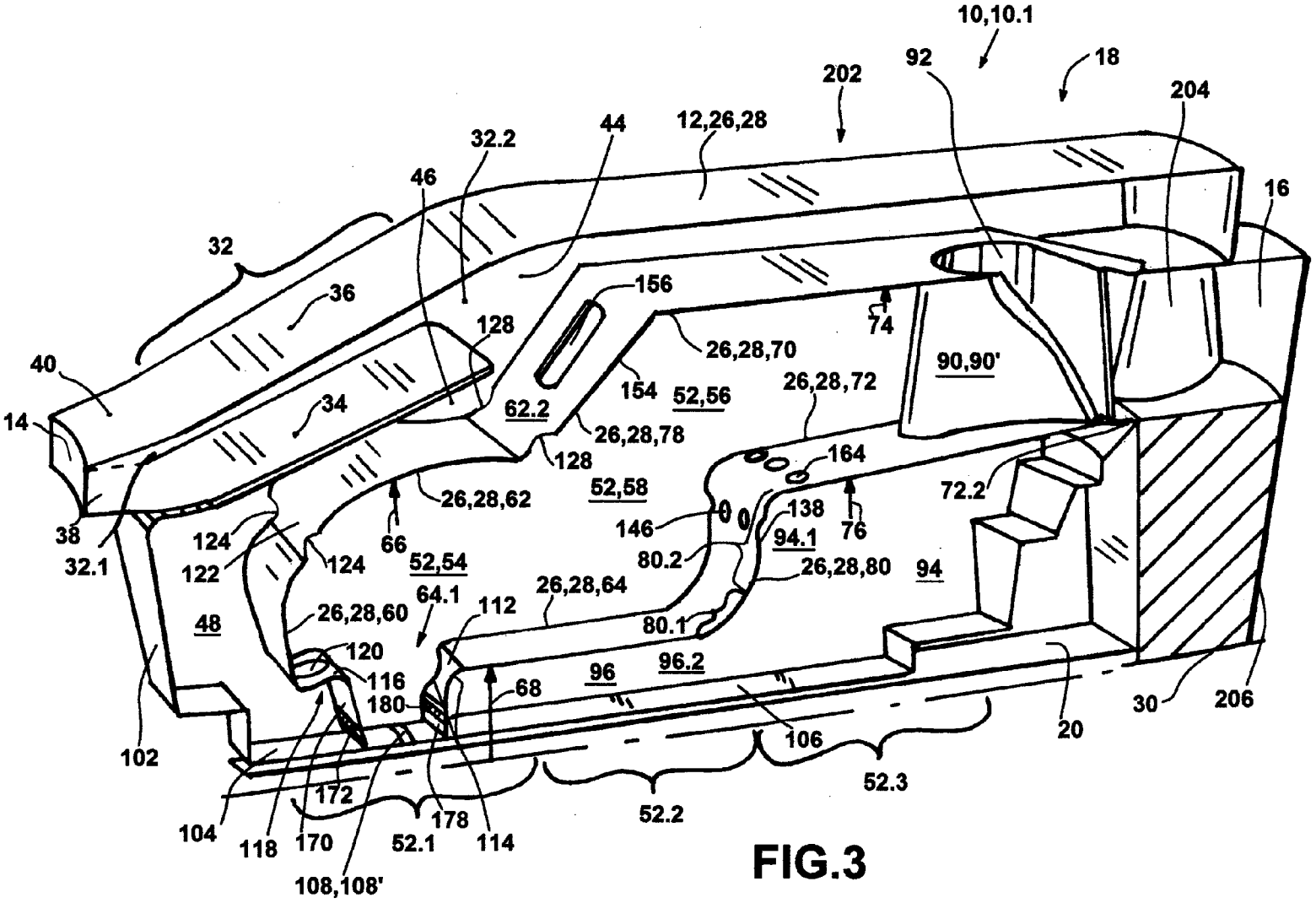
FIG. 3 illustrates an isometric view of a sector portion of the combustion system illustrated in FIG. 1.
Figure 4:
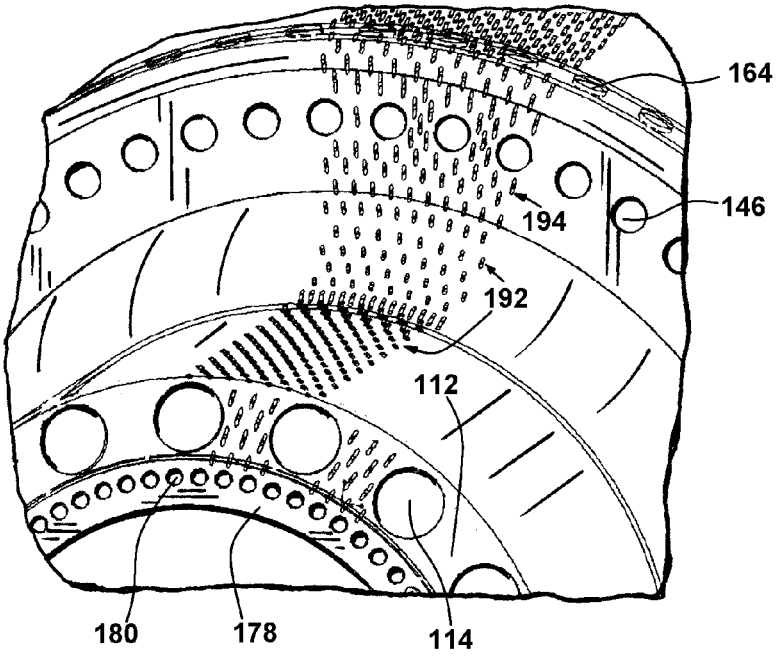
FIG. 4 illustrates an oblique aft-looking inside view of portions of first and second inner surfaces of an annular combustor of the combustion system illustrated in FIGS. 1-3, in halftone and wireframe representations, respectively.
Figure 5:
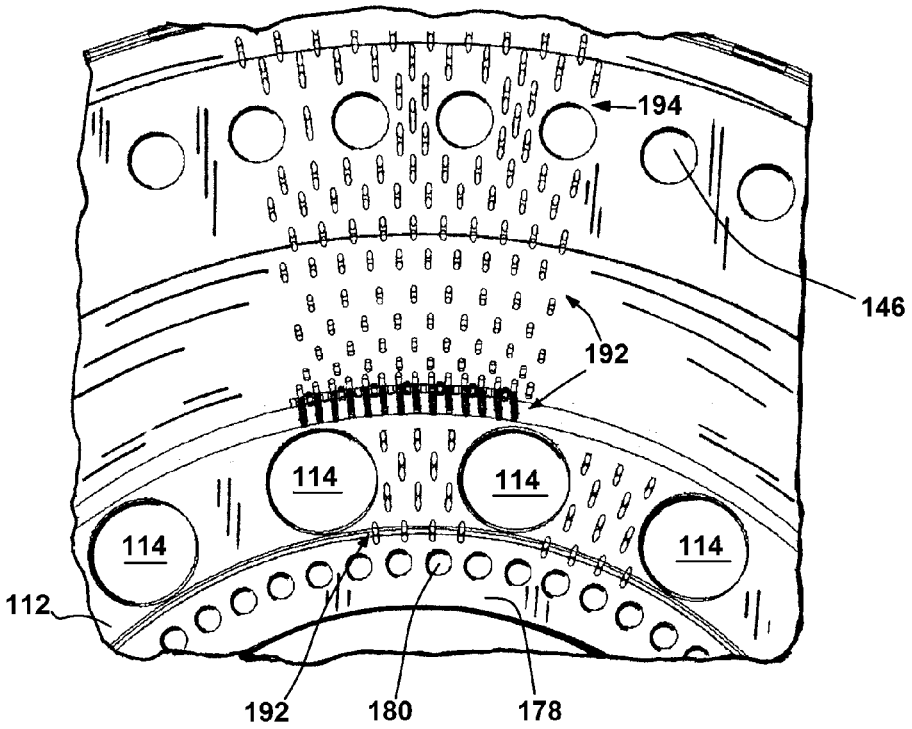
FIG. 5 illustrates an aft-looking inside view of portions of first and second inner surfaces of an annular combustor of the combustion system illustrated in FIGS. 1-3, in halftone and wireframe representations, respectively, corresponding to FIG. 4.

Referring to FIGS. 1-3, a first embodiment of a combustion system 10 comprises an outer housing 12, an annular inlet 14 and an annular outlet 16. In FIGS. 1 and 3, the first embodiment of the combustion system 10 is illustrated in the environment of a turbine engine 18, which incorporates a central rotatable shaft 20 that provides for rotating an associated compressor 22 that provides compressed air 24 to the annular inlet 14. FIG. 2 illustrates a radial cross-section through various surfaces of revolution 26 associated with the structure 28 of the combustion system 10, wherein the surfaces of revolution 26 are revolved about, and the central rotatable shaft 20 is rotatable about, a central axis 30 of the combustion system 10. In FIG. 3 a corresponding sector of the combustion system 10 is shown isolated from the remainder of the combustion system 10.

The annular inlet 14 is in fluid communication with, and supplies compressed air 24 to, an annular diffuser 32 that provides for recovering static pressure from the incoming flow thereto of compressed air 24. This is accomplished by an increase in area with distance from the inlet 32.1 to the outlet 32.2 along the length of the annular diffuser 32. The annular diffuser 32 is bounded by inner 34 and outer 36 generalized conical surfaces, each of which respectively is continuous with, and expands from, corresponding respective inner 38 and outer 40 coaxial bounding surfaces of the annular inlet 14, wherein the outer generalized conical surface 36 expands at a greater angle relative to the central axis 30 of the combustion system 10 than does the inner generalized conical surface 34, so that the radial depth 42.2 of the outlet 32.2 of the annular diffuser 32 is greater than the radial depth 42.1 of the inlet 32.1 of the annular diffuser 32. The outer coaxial bounding surface 40 and the outer generalized conical surface 36 constitute a forward portion 12.1 of the outer housing 12 of the combustion system 10. The outlet 32.2 of the annular diffuser 32 is in fluid communication with an annular manifold plenum 44, which in turn is in fluid communication with a first outer annular plenum 46 and a forward annular plenum 48 in fluid communication therewith, and which is in fluid communication with a second outer annular plenum 50, all of which surround or partially bound an associated annular combustor 52 of the combustion system 10.

The annular combustor 52 comprises a first annular zone 54 at the forward portion 52.1 thereof, a second annular zone 56 in the aft portion 52.3 thereof, and an annular transition zone 58 in an intermediate portion 52.2 thereof between the first 54 and second 56 annular zones. The first annular zone 54 is bounded by a forward surface 60, a first outer surface 62, and a first inner surface 64, for example, each of which are surfaces of revolution 26, wherein a radial dimension 66 of the first outer surface 62 exceeds a corresponding radial dimension 68 of the first inner surface 64 over the first annular zone 54 relative to the central axis 30 of the annular combustor 52, and the first outer surface 62 is continuous with the forward surface 60. The second annular zone 56 is bounded by a second outer surface 70 and a second inner surface 72, for example, each of which are surfaces of revolution 26, wherein a radial dimension 74 of the second outer surface 70 exceeds a corresponding radial dimension 76 of the second inner surface 72 over the second annular zone 56 relative to the central axis 30 of the annular combustor 52. The annular transition zone 58 is bounded by a transitional outer surface 78 and a transitional inner surface 80, for example, each of which are surfaces of revolution 26. The transitional outer surface 78 provides for coupling the first outer surface 62 to the second outer surface 70, wherein a radial dimension 82 of the transitional outer surface 78 at the second outer surface 70 exceeds a corresponding radial dimension 84 of the transitional outer surface 78 at the first outer surface 62. The transitional inner surface 80 provides for coupling the first inner surface 64 to the second inner surface 72, wherein a radial dimension 86 of the transitional inner surface 80 at the second inner surface 72 exceeds a corresponding radial dimension 88 of the transitional inner surface 80 at the first inner surface 64.

At least one radial strut or vane 90 extends through and across the aft portion 56.2 of the second annular zone 56 from the second outer surface 70 to the second inner surface 72, and a hollow interior 92 of the at least one radial strut or vane 90 provides for fluid communication between the second outer annular plenum 50 and a corresponding second inner annular plenum 94 adjacent to both the second inner surface 72 and the transitional inner surface 80. Accordingly, the second inner annular plenum 94 is in fluid communication with the annular manifold plenum 44 through hollow interior 92 of the at least one radial strut or vane 90 and through the second outer annular plenum 50. A first inner annular plenum 96 adjacent to the first inner surface 64 is adjacent to and in fluid communication with the second inner annular plenum 94, and is in fluid communication with the annular manifold plenum 44 therethrough, and through hollow interior 92 of the at least one radial strut or vane 90 and through the second outer annular plenum 50.

Figure 11A:
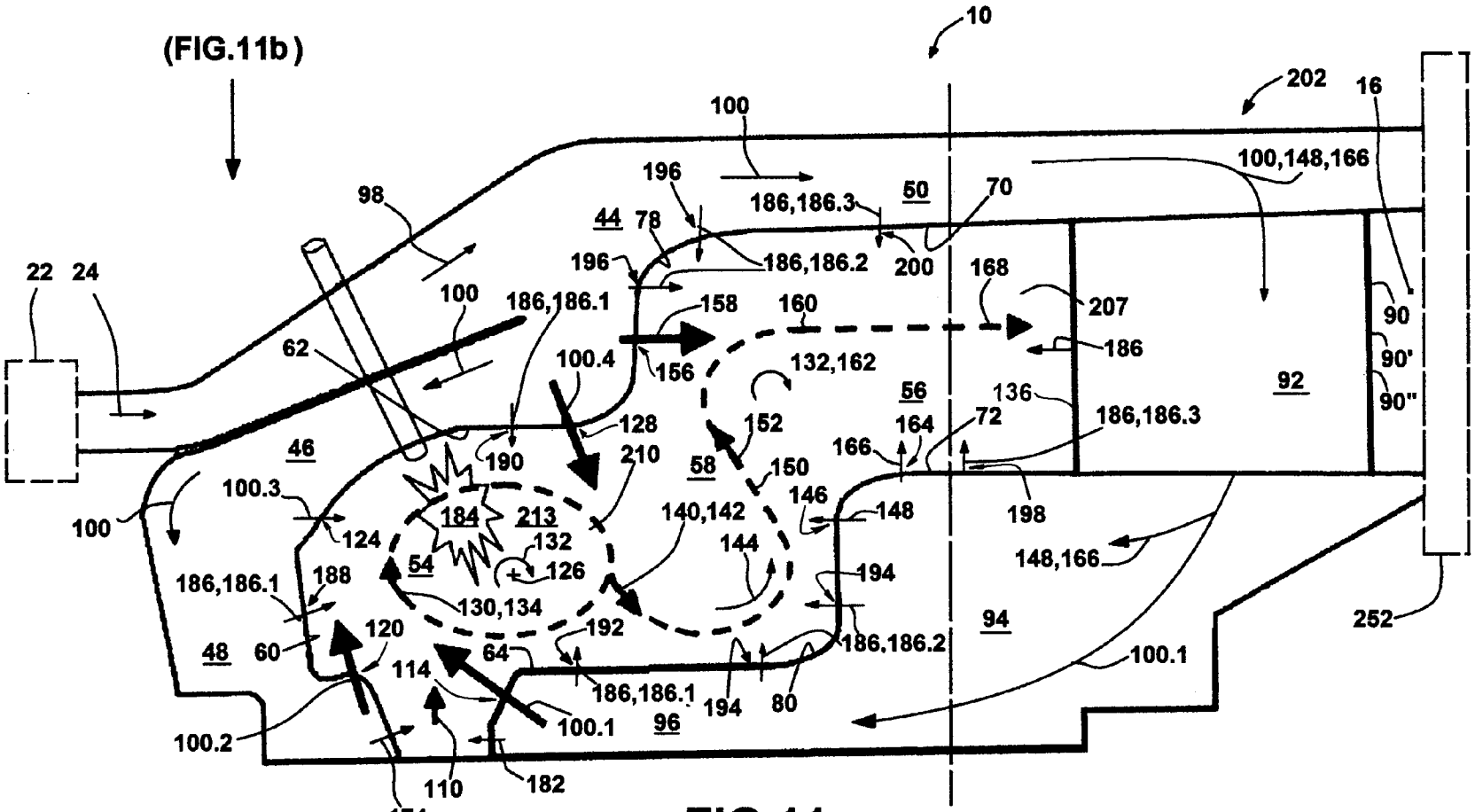
FIG. 11*a* illustrates a radial cross-section of the combustion system illustrated in FIG. 1, and further illustrates the operation of the combustion system.
Figure 11B:
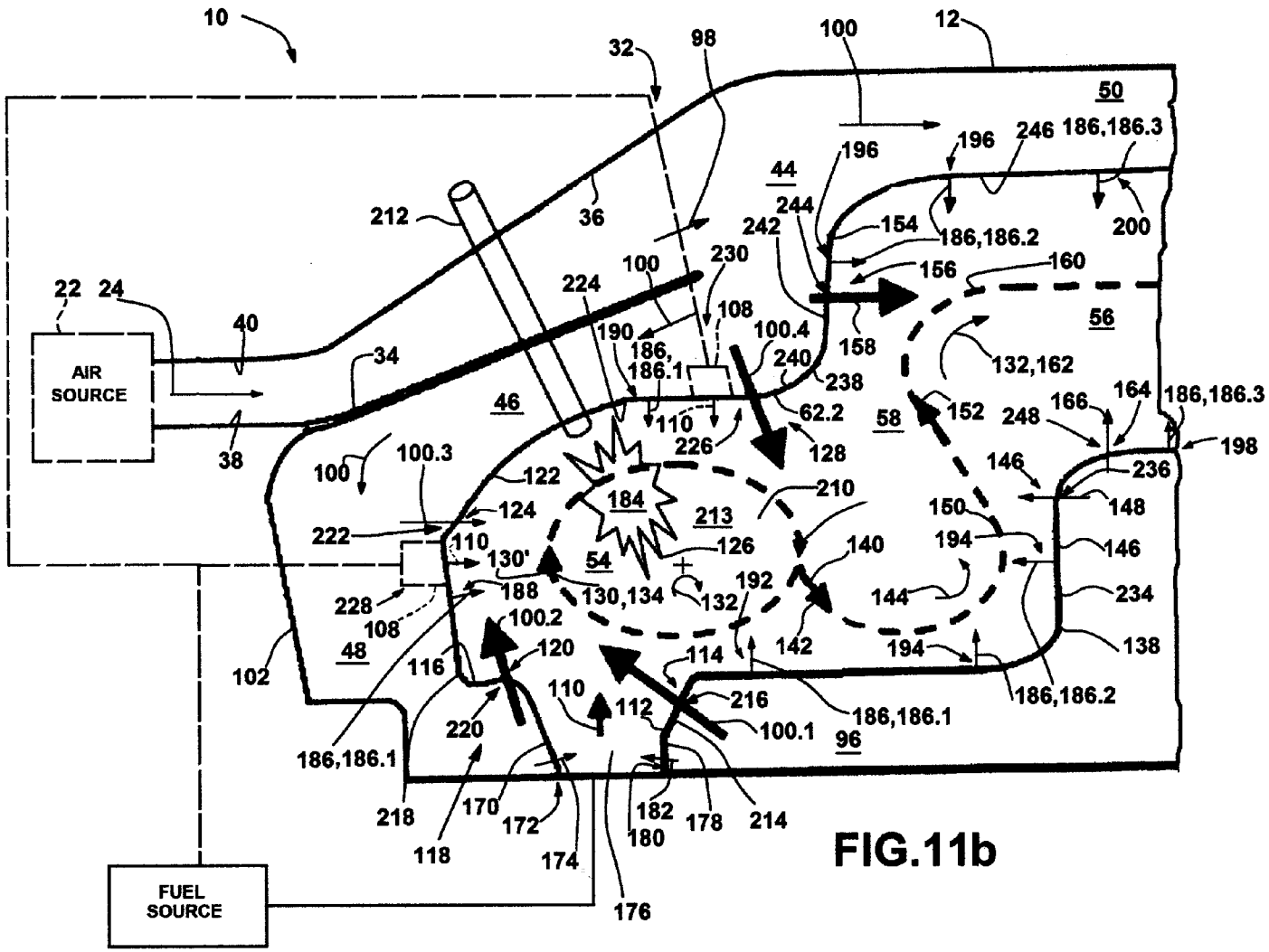
FIG. 11*b* illustrates an expanded portion of FIG. 11*b*.

The annular manifold plenum 44 is located aft of the annular diffuser 32 at the outlet 32.2 thereof, between the outer housing 12 and the transitional outer surface 78 of the annular combustor 52, and receives diffused air 98 from the outlet 32.2 of the annular diffuser 32. Referring also to FIGS. 11*a* and 11*b*, the annular manifold plenum 44 distributes a portion of a first portion of air 100 to the first outer annular plenum 46, and from there, also to the forward annular plenum 48, and distributes a remaining portion of the first portion of air 100 to the first inner annular plenum 96 via the second outer annular plenum 50, the hollow interior 92 of the at least one radial strut or vane 90, and the second inner annular plenum 94. The first outer annular plenum 46 is located between the inner generalized conical surface 34 of the annular diffuser 32 and the first outer surface 62 of the first annular zone 54 of the annular combustor 52. The forward annular plenum 48 is located between the forward surface 60 of the first annular zone 54 of the annular combustor 52, and a forward surface 102 of the combustion system 10, wherein the forward surface 102 extends from the inner generalized conical surface 34 to a first inner plenum boundary 104, the latter of which extends to the forward surface 60 of the first annular zone 54, wherein the forward surface 102 and the first inner plenum boundary 104 are surfaces of revolution 26 about the central axis 30 of the combustion system 10. The second outer annular plenum 50 is located between an aft portion 12.2 of the outer housing 12 and the second outer surface 70 of the second annular zone 56 of the annular combustor 52. A second inner plenum boundary 106—for example, a surface of revolution 26—extends from the forward end portion 64.1 of the first inner surface 64 of the first annular zone 54 of the annular combustor 52 to the aft end portion 72.2 of the second inner surface 72 of the second annular zone 56 of the annular combustor 52. The first inner annular plenum 96 is located between the second inner plenum boundary 106 and the first inner surface 64 of the first annular zone 54 of the annular combustor 52, and the second inner annular plenum 94 is located between the second inner plenum boundary 106 and the second inner surface 72 of the second annular zone 56 of the annular combustor 52. The first 96 and second 94 inner annular plenums are continuous with one another at the transitional inner surface 80 of the annular transition zone 58, wherein an aft portion 96.2 of the first inner annular plenum 96 is bounded by a forward portion 80.1 of the transitional inner surface 80, and a forward portion 94.1 of the second inner annular plenum 94 is bounded by an aft portion 80.2 of the transitional inner surface 80.

Figure 6:
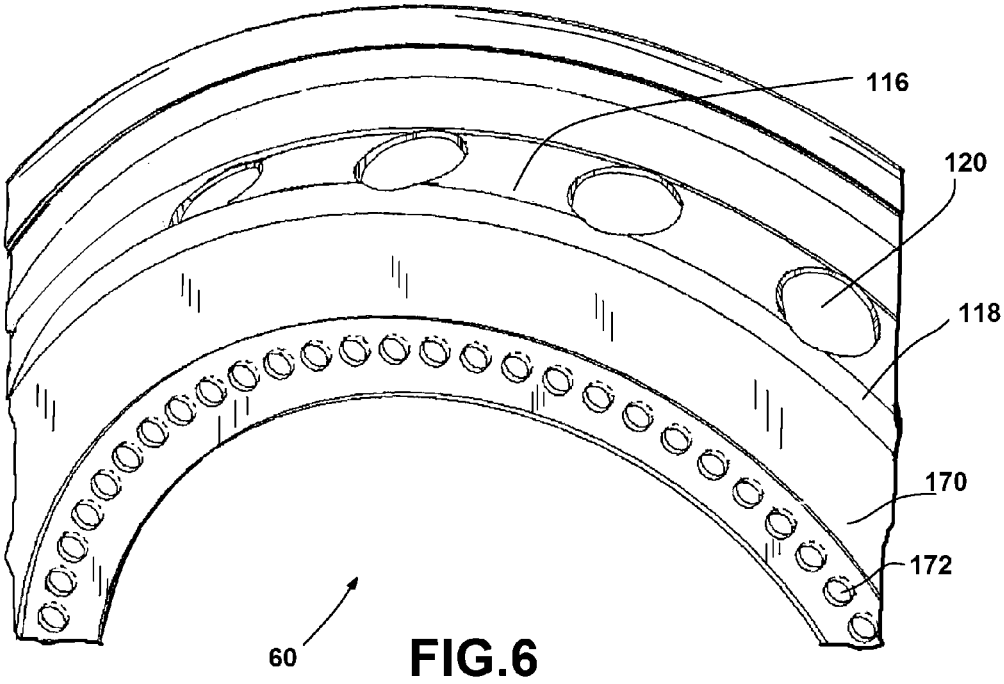
FIG. 6 illustrates an oblique forward-looking inside view of a radially-inward portion of the forward surface of the annular combustor of the combustion system illustrated in FIGS. 1-3, in halftone and wireframe representations, respectively.
Figure 7:
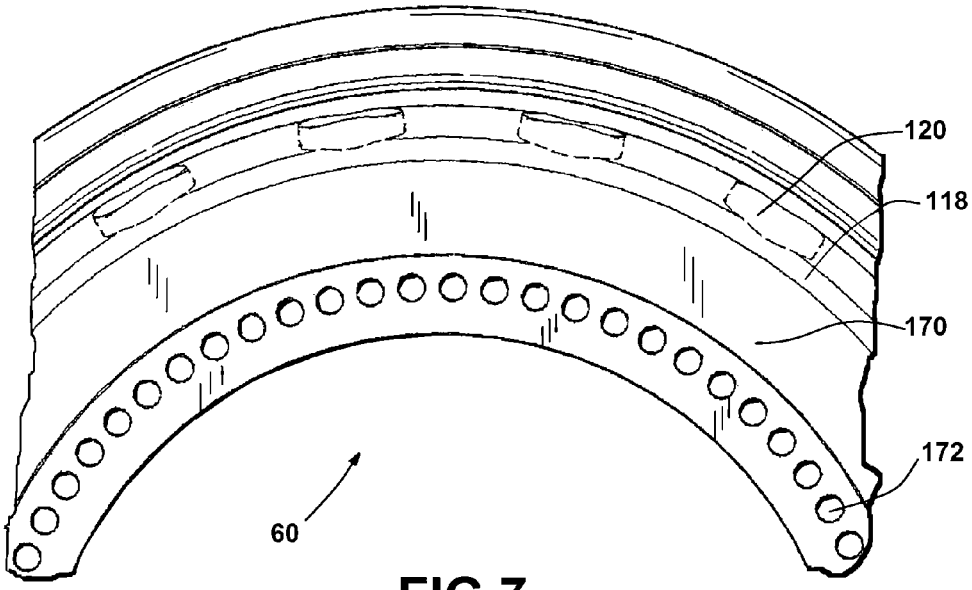
FIG. 7 illustrates a forward-looking inside view of a radially-inward portion of the forward surface of the annular combustor of the combustion system illustrated in FIGS. 1-3, in halftone and wireframe representations, respectively, corresponding to FIG. 6.
Figure 8:
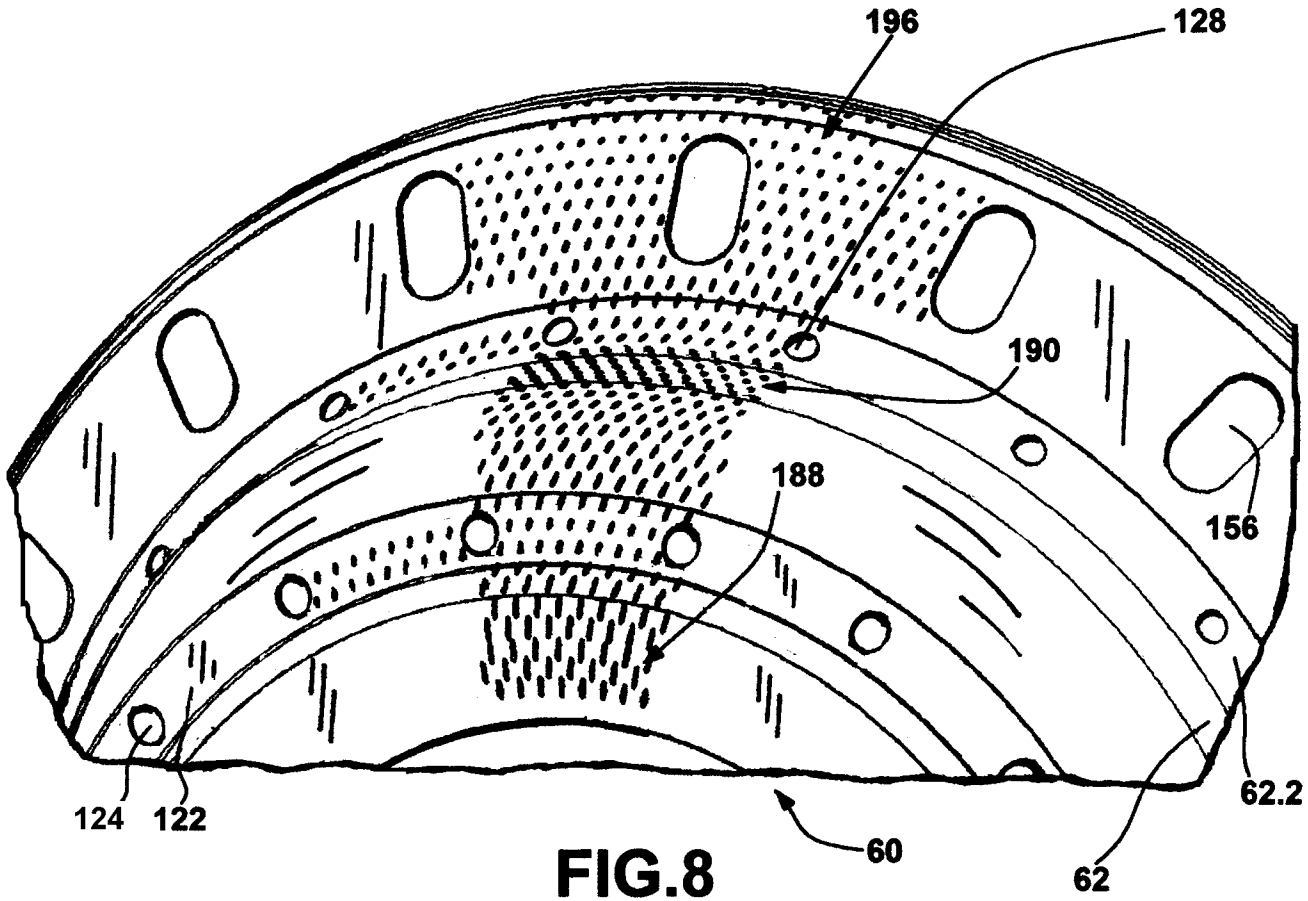
FIG. 8 illustrates an oblique aft-looking outside view of portions of the forward surface, the first outer surface, and the transitional outer surface of an annular combustor of the combustion system illustrated in FIGS. 1-3, in halftone and wireframe representations, respectively.
Figure 9:
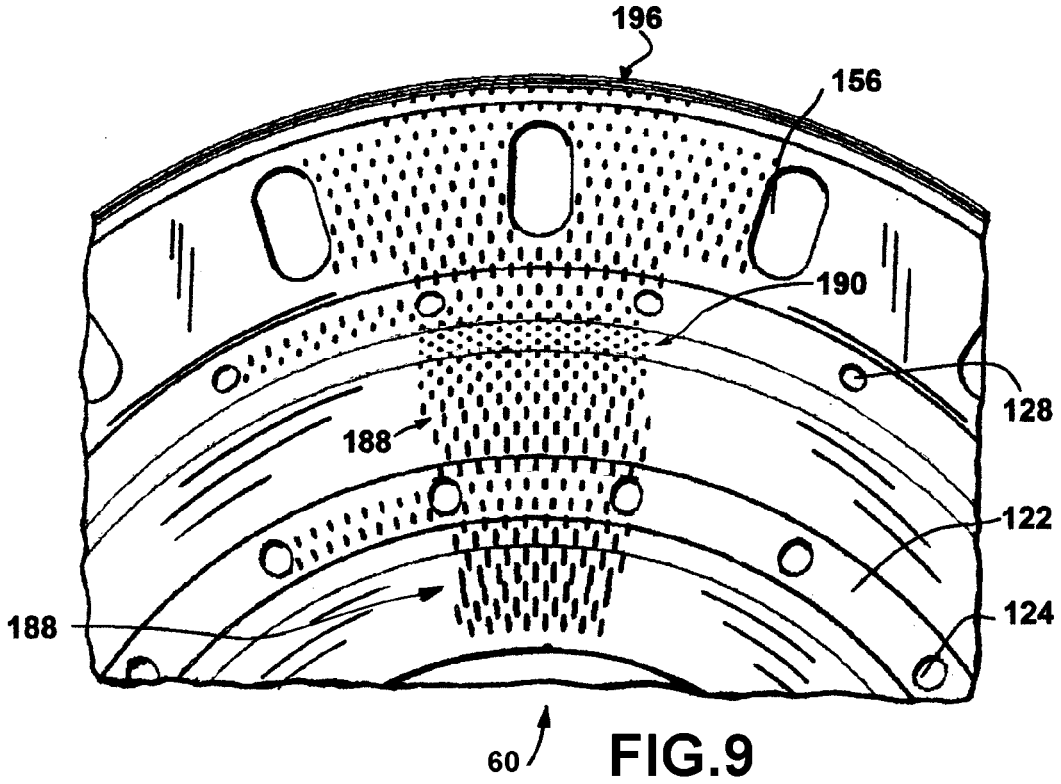
FIG. 9 illustrates an aft-looking outside view of portions of the forward surface, the first outer surface, and the transitional outer surface of an annular combustor of the combustion system illustrated in FIGS. 1-3, in halftone and wireframe representations, respectively, corresponding to FIG. 8.

In accordance with a first embodiment, the combustion system 10.1 incorporates a fuel slinger or injector 108 operatively coupled to the central rotatable shaft 20 and adapted to sling or inject fuel 110 into the first annular zone 54 of the annular combustor 52. For example, the fuel slinger or injector 108 could be constructed in accordance with the teachings of any of U.S. Pat. No. 4,870,825; U.S. Pat. No. 6,925,812 that issued from application Ser. No. 10/249,967 filed on 22 May 2003; or U.S. Pat. No. 6,988,367 that issued from application Ser. No. 10/709,199 filed on 20 Apr. 2004, all of which are incorporated herein by reference, for example, as illustrated in FIGS. 1 and 6 of U.S. Pat. No. 6,988,367 by either of the fuel discharge orifices 92, 134 in cooperation with associated rotary fluid traps 96, 136, respectively; or as illustrated in FIGS. 1-11 of U.S. Pat. No. 6,925,812 by either the fuel slinger 20 or by the rotary injector 10 comprising an arm 48 and associated fluid passage 60, but each adapted to sling or inject fuel 110 into the first annular zone 54 of the annular combustor 52. Alternatively, the fuel slinger or injector 108 could be constructed in accordance with the teachings of U.S. Provisional Application No. 61/043,723 filed on 9 Apr. 2008, which is also incorporated herein by reference.

Referring to FIGS. 2-5, an oblique forward-outward-facing portion 112 of the forward end portion 64.1 of the first inner surface 64 of the annular combustor 52 incorporates a plurality of first orifices 114 extending therethrough and adapted to inject a portion 100.1 of the first portion of air 100 from the first inner annular plenum 96 in a direction that is forwards and radially outwards within the first annular zone 54 of the annular combustor 52 from a location that is aft of the fuel slinger or injector 108.

Referring to FIGS. 2, 3, 6 and 7, an outward-facing portion 116 of a step 118 on the forward surface 60 of the first annular zone 54 of the annular combustor 52 incorporates a plurality of second orifices 120 extending therethrough and adapted to inject a portion 100.2 of the first portion of air 100 from the forward annular plenum 48 in a direction that is radially outwards within the first annular zone 54 of the annular combustor 52 from a location that is forward of the fuel slinger or injector 108.

Referring to FIGS. 2, 3, 8 and 9, an aftward-facing portion 122 of the forward surface 60 of the first annular zone 54 of the annular combustor 52 incorporates a plurality of third orifices 124 extending therethrough and adapted to inject a portion 100.3 of the first portion of air 100 from the forward annular plenum 48 in a direction that is at least partially aftwards within the first annular zone 54 of the annular combustor 52 from a location that is radially outwards of a center 126 of the first annular zone 54. Furthermore, an aft portion 62.2 of the first outer surface 62 of the annular combustor 52 incorporates a plurality of fourth orifices 128 extending therethrough and adapted to inject a portion 100.4 of the first portion of air 100 from the first outer annular plenum 46 in a direction that is at least partially radially inwards within the first annular zone 54 of the annular combustor 52 from a location that is aftward of the center 126 of the first annular zone 54.

Accordingly, the portions 100.1, 100.2, 100.3 and 100.4 of the first portion of air 100, individually and collectively, provide for inducing a first poloidal flow 130 of the first portion of air 100 within the first annular zone 54 of the annular combustor 52 in a first poloidal direction 132 therein.

Furthermore, in one embodiment, the at least one radial strut or vane 90 is oriented, for example, radially canted, so as to introduce a circumferential component of swirl to the flow of the portion 100.1 of the first portion of air 100 flowing within the first inner annular plenum 96, which results in a corresponding circumferential component of flow of the portion 100.1 of the first portion of air 100 when injected into the first annular zone 54 of the annular combustor 52, which provides for inducing a toroidal helical flow 134 of the first portion of air 100 within the first annular zone 54 of the annular combustor 52. Furthermore, the angular momentum of fuel 110 injected from a rotating fuel slinger or injector 108 can either provide for or contribute to the circumferential component of flow of the associated toroidal helical flow 134, particularly if the rotating fuel slinger or injector 108 is rotating in the same direction as that of the swirl of the portion 100.1 of the first portion of air 100 within the first inner annular plenum 96. As used herein, the terms poloidal, circumferential and toroidal helical are in reference to a representation of an associated annular zone by a generalized torus having a linear major axis aligned with the central axis 30 of the combustion system 10 and a circular minor axis in the center of the associated annular zone, wherein the cross-sectional shape of the generalized torus is given by the cross-sectional shape of the associated annular zone. With reference to this generalized torus, the term poloidal refers to a direction of circulation about the minor axis of the generalized torus, the term circumferential refers to a direction of circulation about the major axis of the generalized torus, and toroidal helical refers to a combination of poloidal and circumferential directions.

Furthermore, in another embodiment, the plurality of first orifices 114 are azimuthally offset in angle with respect to the plurality of second orifices 120 relative to the central axis 30 of the combustion system 10 so as to provide for enhanced mixing of the first portion of air 100 with the fuel 110 within the first annular zone 54 of the annular combustor 52. For example, in one embodiment, the plurality of first orifices 114 are interleaved, i.e. offset or out-of-line, with respect to the leading edges 136 of a corresponding plurality of radial struts or vanes 90, the corresponding plurality of second orifices 120 are substantially azimuthally aligned, i.e. in-line, with the corresponding plurality of radial struts or vanes 90, and the corresponding pluralities of third 124 and forth 128 orifices are substantially azimuthally aligned with the plurality of first orifices 114 out-of-line with respect to the plurality of radial struts or vanes 90. The azimuthally offset plurality of first orifices 114 may also contribute to a toroidal helical flow 134 of the first portion of air 100 within the first annular zone 54 of the annular combustor 52 when used in combination with the above-described radially canted at least one radial strut or vane 90 and or in combination with a rotating fuel slinger or injector 108.

Referring to FIGS. 2-5, the transitional inner surface 80 of the annular transition zone 58 comprises a radially-outwardly-extending annular step 138 that provides for deflecting a first combustion gas 140 exiting the first annular zone 54 of the annular combustor 52. The first poloidal direction 132 of the first poloidal flow 130 is such that the first combustion gas 140 exiting the first annular zone 54 of the annular combustor 52 exits therefrom in an at least partially radially inward direction towards the first inner surface 64 of the first annular zone 54 and the portion of the transitional inner surface 80 extending therefrom, which surfaces 64, 80 redirect the first combustion gas 140 within the annular transition zone 58 of the annular combustor 52 into at least a partial second poloidal flow 142 in a second poloidal direction 144 therein, wherein the second poloidal direction 144 is opposite to the first poloidal direction 132. As used herein, the terms "partial poloidal flow" and "poloidal flow" are intended to mean flows that follow at least a portion of a poloidal path, i.e. flows that change direction within an annular region, but that do not necessarily fully circulate so as to change direction by at least 360 degrees. The radially-outwardly-extending annular step 138 of the transitional inner surface 80 further contributes to the redirection of the first combustion gas 140 into the second poloidal flow 142. Furthermore, the radially-outwardly-extending annular step 138 of the transitional inner surface 80 incorporates a plurality of fifth orifices 146 extending therethrough and adapted to inject a second portion of air 148 from the second inner annular plenum 94 in a direction that is at least partially forwards within the annular transition zone 58 of the annular combustor 52 from a location that is radially outwards of the first inner surface 64 of the first annular zone 54 of the annular combustor 52, wherein the second portion of air 148 is supplied to the second inner annular plenum 94 from the annular manifold plenum 44 through the second outer annular plenum 50 and then through the hollow interior 92 of the at least one radial strut or vane 90. Accordingly, the second portion of air 148 injected at least partially forward from the plurality of fifth orifices 146 provides for further combusting and mixing with the first combustion gas 140 from the first annular zone 54, thereby generating a second combustion gas 150 therefrom, and the second portion of air 148 further provides for or contributes to the second poloidal flow 142 of the second combustion gas 150 in the second poloidal direction 144 within the annular transition zone 58 of the annular combustor 52. Accordingly, the second portion of air 148 injected at least partially forward from the plurality of fifth orifices 146 at least in part provides for transforming the first combustion gas 140 to the second combustion gas 150 within the annular transition zone 58 of the annular combustor 52.

Referring to FIGS. 2, 3, 8 and 9, the second poloidal direction 144 of the second poloidal flow 142 is such that the second combustion gas 150 within the annular transition zone 58 of the annular combustor 52 is directed towards the transitional outer surface 78 of the annular transition zone 58, which redirects the second combustion gas 150 within the annular transition zone 58 of the annular combustor 52 into at least a partial third poloidal flow 152 in the first poloidal direction 132 therein, thereby reversing the poloidal direction of flow of the second combustion gas 150. Furthermore, an aftward-facing portion 154 of the transitional outer surface 78 of the annular transition zone 58 incorporates a plurality of sixth orifices 156 extending therethrough and adapted to inject a third portion of air 158 from the annular manifold plenum 44 in a direction that is at least partially aftwards within the annular transition zone 58 of the annular combustor 52 from a location that is radially outwards of the first outer surface 62 of the first annular zone 54 of the annular combustor 52, wherein the third portion of air 158 is supplied directly from the annular manifold plenum 44. Accordingly, the third portion of air 158 injected at least partially aftwards from the plurality of sixth orifices 156 provides for further combusting and mixing with the second combustion gas 150 within the first annular zone 54, thereby generating a third combustion gas 160 therefrom, and the third portion of air 159 further provides for or contributes to the third poloidal flow 152 of the third combustion gas 160 in the first poloidal direction 132 within the annular transition zone 58 of the annular combustor 52. Accordingly, the third portion of air 158 injected at least partially aftwards from the plurality of sixth orifices 156 at least in part provides for transforming the second combustion gas 150 to the third combustion gas 160 within the annular transition zone 58 of the annular combustor 52. In one embodiment, the plurality of sixth orifices 156 are substantially azimuthally aligned, i.e. in-line, with a corresponding plurality of radial struts or vanes 90 so that the third portion of air 158 injected therefrom flows over and continuously coats the radial struts or vanes 90 so as to provide convective cooling thereof. In another embodiment, the plurality of sixth orifices 156 are also substantially azimuthally offset, or interleaved, relative to the plurality of first orifices 114, so as to provide for enhanced mixing of the third combustion gas 160 with the third portion of air 158 within the annular transition zone 58 of the annular combustor 52. In yet another embodiment, the at least one radial strut or vane 90 is oriented, for example, radially canted, so as to introduce a circumferential component of swirl to the flow of second portion of air 148 flowing within the second inner annular plenum 94, which results in a corresponding circumferential component of flow of the second portion of air 148 when injected into the annular transition zone 58 of the annular combustor 52, which provides for inducing a toroidal helical flow 162 of the third combustion gas 160 therewithin.

Referring to FIGS. 2-5, a plurality of seventh orifices 164 are located on, and extend through, the second inner surface 72 and are oriented so as to provide for injecting a fourth portion of air 166 from the second inner annular plenum 94 in a direction that is radially outwards within the second annular zone 56 of the annular combustor 52, wherein the fourth portion of air 166 is supplied to the second inner annular plenum 94 from the annular manifold plenum 44 through the second outer annular plenum 50 and then through the hollow interior 92 of the at least one radial strut or vane 90. Accordingly, the fourth portion of air 166 injected radially outwards from the plurality of seventh orifices 164 provides for diluting and mixing with the third combustion gas 160 from the annular transition zone 58, thereby generating a fourth combustion gas 168 therefrom. Accordingly, the fourth portion of air 166 injected radially outwards from the plurality of seventh orifices 164 provides for transforming the third combustion gas 160 to the fourth combustion gas 168 within the second annular zone 56 of the annular combustor 52.

Referring to FIGS. 2, 3, 6 and 7, a radially-inward, aftward facing portion 170 of the forward surface 60 of the first annular zone 54 of the annular combustor 52 incorporate a plurality of eighth orifices 172 extending therethrough and adapted to inject a fifth portion of air 174 from the forward annular plenum 48 in a direction that is aftwards and within a region 176 of the first annular zone 54 of the annular combustor 52 within which fuel 110 in injected by the fuel slinger or injector 108. Referring to FIGS. 2-5, of a radially-inward, forward facing portion 178 of the forward end portion 64.1 of the first inner surface 64 of the annular combustor 52 incorporates a plurality of ninth orifices 180 extending therethrough and adapted to inject a sixth portion of air 182 from the first inner annular plenum 96 in a direction that is forwards and within the region 176 of the first annular zone 54 of the annular combustor 52 within which fuel 110 in injected by the fuel slinger or injector 108. The fifth 174 and sixth 182 portions of air are respectively provided to the forward annular plenum 48 and the first inner annular plenum 96 from the annular manifold plenum 44, via the first outer annular plenum 46 and via the second outer annular plenum 50, the hollow interior 92 of the at least one radial strut or vane 90, and the second inner annular plenum 94, respectively. The fifth 174 and sixth 182 portions of air are mix with the fuel 110 following injection thereof into the first annular zone 54 of the annular combustor 52 by the fuel slinger or injector 108. The fuel 110 continues to burn thereafter with a stable flame 184 within the first annular zone 54.

The various surfaces 60, 62, 64, 80, 78, 72, 70 of the annular combustor 52 are cooled by effusion cooling with associated effusion cooling air 186 provided by corresponding associated effusion cooling orifices 188, 190, 192, 194, 196, 198, 200 on and extending through the associated surfaces 60, 62, 64, 80, 78, 72, 70 of the annular combustor 52. More particularly the forward surface 60 of the first annular zone 54 of the annular combustor 52 incorporates a first set of effusion cooling orifices 188 extending therethrough and adapted to inject effusion cooling air 186 from the forward annular plenum 48 along the forward surface 60 within the first annular zone 54 of the annular combustor 52 so as to provide for effusion cooling thereof. Furthermore, the first outer surface 62 of the first annular zone 54 of the annular combustor 52 incorporates a second set of effusion cooling orifices 190 extending therethrough and adapted to inject effusion cooling air 186 from the first outer annular plenum 46 along the first outer surface 62 within the first annular zone 54 of the annular combustor 52 so as to provide for effusion cooling thereof. Yet further, at least one of the first inner surface 64 of the first annular zone 54 of the annular combustor 52 and the transitional inner surface 80 of the annular transition zone 58 of the annular combustor 52 incorporate a third set of effusion cooling orifices 192 extending therethrough and adapted to inject effusion cooling air 186 from the first inner annular plenum 96 either along the first inner surface 64 within the first annular zone 54 of the annular combustor 52, or along the transitional inner surface 80 of the annular transition zone 58 of the annular combustor 52, so as to provide for effusion cooling thereof. Yet further, the transitional inner surface 80 of the annular transition zone 58 of the annular combustor 52 incorporates a fourth set of effusion cooling orifices 194 extending therethrough and adapted to inject effusion cooling air 186 from the second inner annular plenum 50 along the transitional inner surface 80 within the annular transition zone 58 of the annular combustor 52 so as to provide for effusion cooling thereof. Yet further, the transitional outer surface 78 of the annular transition zone 58 of the annular combustor 52 incorporates a fifth set of effusion cooling orifices 196 extending therethrough and adapted to inject effusion cooling air 186 from the annular manifold plenum 44 along the transitional outer surface 78 within the annular transition zone 58 of the annular combustor 52 so as to provide for effusion cooling thereof. Yet further, the second inner surface 72 of the second annular zone 56 of the annular combustor 52 incorporates a sixth set of effusion cooling orifices 198 extending therethrough and adapted to inject effusion cooling air 186 from the second inner annular plenum 94 along the second inner surface 72 within the second annular zone 56 of the annular combustor 52 so as to provide for effusion cooling thereof. Yet further, the second outer surface 70 of the second annular zone 56 of the annular combustor 52 incorporates a seventh set of effusion cooling orifices 200 extending therethrough and adapted to inject effusion cooling air 186 from the second outer annular plenum 50 along the second outer surface 70 within the second annular zone 56 of the annular combustor 52 so as to provide for effusion cooling thereof.

The effusion cooling air 186 is provided to the associated forward annular plenum 48, first outer annular plenum 46, first inner annular plenum 96 and the second inner annular plenum 50 from the annular manifold plenum 44 in the same manner as the first 100, second 148, third 158, fourth 166, fifth 174 and sixth 182 portions of air as described hereinabove.

In one embodiment, the total amount of the first 100, second 148, third 158, fifth 174 and sixth 182 portions of air, and the total amount of effusion cooling air 186 injected from the first 188, second 190, third 192, fourth 194 and fifth 196 sets of effusion cooling orifices, i.e. to total amount of air introduced upstream of the radially-outwardly-extending annular step 138 of the transitional inner surface 80, is at or near stoichiometric in relation to the amount of fuel 110 injected from the fuel slinger or injector 108 into the first annular zone 54 of the annular combustor 52. Accordingly, the remaining fourth portion of air 166 and the effusion cooling air 186 injected from the sixth 198 and seventh 200 sets of effusion cooling orifices provides for diluting the third combustion gas 160 from the annular transition zone 58 so that the resulting fourth combustion gas 168 is on average leaner than stoichiometric.

Figure 10:
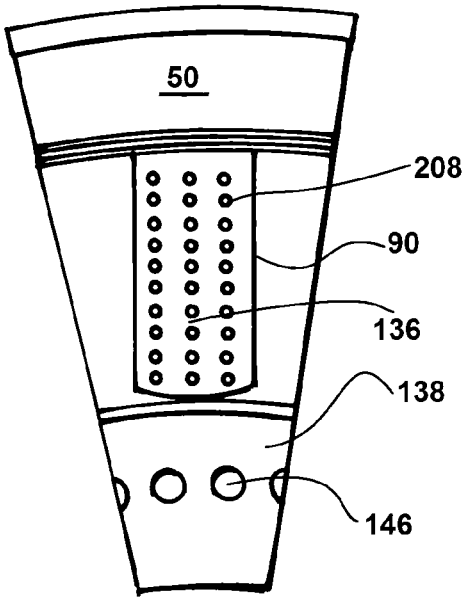
FIG. 10 illustrates an aft-looking inside view of portions of the transitional inner surface, the second outer surface, a radial vane, the transitional outer surface of an annular combustor, and the aft end of the second outer annular plenum, of the combustion system illustrated in FIGS. 1-3, for the sector identified in FIG. 1 and illustrated in FIG. 3.

Referring to FIGS. 2, 3, 10 and, 11, in one embodiment, the fourth combustion gas 168 from the second annular zone 56 of the annular combustor 52 is discharged through a nozzle 202 containing a plurality of radial vanes 90' located downstream of the second annular zone 56, which redirect the fourth combustion gas 168 therefrom onto the blades 204 of a turbine 206 which is operatively coupled to and which drives the central rotatable shaft 20. For example, FIG. 3 illustrates one of a plurality of radial vanes 90' with a hollow interior 92 that provide for fluid communication between the second outer annular plenum 50 and the corresponding second inner annular plenum 94, wherein each of the plurality of radial vanes 90' is cambered so as to provide for redirecting the fourth combustion gas 168 onto the blades 204 of the turbine 206. Accordingly, the nozzle 202 provides for generating a back pressure 207 within the annular combustor 52, which enables the associated flow fields within the annular combustor 52, thereby providing for the above-described operation thereof.

Alternatively, the at least one radial strut or vane 90 could constitute at least one radial strut 90" with a hollow interior that provides for fluid communication between the second outer annular plenum 50 and the corresponding second inner annular plenum 94. For example, in one embodiment, the at least one radial strut 90" is shaped so as to minimize aerodynamic drag or associated pressure loss. In one embodiment, each at least one radial strut or vane 90 incorporates an associated eighth set of effusion cooling orifices 208 extending through at least portions of the surfaces thereof and adapted to inject effusion cooling air 186 from the hollow interiors 92 thereof along the outer surfaces of the at least one radial strut or vane 90 so as to provide for effusion cooling thereof.

Referring to FIGS. 11*a* and 11*b*, a method of operating a combustion system 10 comprises injecting fuel 110 into a first annular zone 54 of an annular combustor 52 and injecting a first portion of air 100 into the first annular zone 54 of the annular combustor 52, wherein at least one of the operations of injecting the fuel 110 and injecting the first portion of air 100 provides for inducing a first poloidal flow 130 of a resulting fuel/air mixture 210 in a first poloidal direction 132 within the first annular zone 54 of the annular combustor 52. The resulting fuel/air mixture 210 is initially ignited by an igniter 212 that initiates combustion within a primary combustion zone 213 within the first annular zone 54 of the annular combustor 52, which, following ignition, is self-sustaining, wherein an ignition flame from the igniter 212 extends into the primary combustion zone 213 within which the fuel/air mixture 210 circulates as part of the first poloidal flow 130, and the resulting associated hot combustion products recirculate with the fuel/air mixture 210 within the primary combustion zone 213 so as to provide for the self-sustaining combustion thereof.

In accordance with a first aspect, the operation of injecting the fuel 110 comprises injecting at least a portion of the fuel 110 within the annular combustor 52 from a fuel slinger or injector 108, for example, from a rotary injector 108' operatively associated with the central rotatable shaft 20 and adapted to rotate therewith.

Alternatively, the fuel 110 could be injected from relatively fixed, central fuel injectors, for example, situated in a location similar to the fuel slinger or injector 108 illustrated in FIGS. 2, 3 11*a* and 11*b*, but not rotating, for example, in a combustion system 10 that does not incorporate a central rotatable shaft 20.

In accordance with a second aspect, the injection of the first portion of air 100 at least partially contributes to inducing the first poloidal flow 130 within the first annular zone 54 of the annular combustor 52. For example, in one set of embodiments in accordance with the second aspect, the operation of injecting the first portion of air 100 into the first annular zone 54 comprises at least one of the following:

1) injecting at least a portion 100.1 of the first portion of air 100 at least partially radially outwards and at least partially forward from a radially inward boundary 214 of the first annular zone 54, for example, from the first inner surface 64 of the first annular zone 54, from a location 216 that is aftward of a forward boundary 218 of the first annular zone 54, for example, aftward of the forward surface 60 of the first annular zone 54, e.g. aftward of the region 176 of the first annular zone 54 of the annular combustor 52 within which fuel 110 in injected by the fuel slinger or injector 108;

2) injecting at least a portion 100.2 of the first portion of air 100 at least partially radially outwards from the forward boundary 218 of the first annular zone 54, for example from the forward surface 60 of the first annular zone 54, from a location 220 that is radially inward of the center 126 of the first annular zone 54;

3) injecting at least a portion 100.3 of the first portion of air 100 at least partially aftwards from the forward boundary 218 of the first annular zone 54 of the first annular zone 54, for example from the forward surface 60 of the first annular zone 54, from a location 222 that is radially outward of the center 126 of the first annular zone 54; or 4) injecting at least a portion 100.4 of the first portion of air 100 at least partially radially inwards from a radially outward boundary 224 of the first annular zone 54, for example, from the first outer surface 62 of the first annular zone 54, from a location 226 that is aftward of a center 126 of the first annular zone 54.

In accordance with a third aspect, the injection of the fuel 110 at least partially contributes to inducing the first poloidal flow 130 within the first annular zone 54 of the annular combustor 52. For example, in one embodiment in accordance with the third aspect, at least a portion of the fuel 110 is injected from a location that is fixed relative to a surface of the annular combustor 52, for example, from a first location 228 on the forward surface 60 of the first annular zone 54 directed aftwards and upwards relative to the center 126 of the first annular zone 54, or from a second location 230 on the first outer surface 62 of the first annular zone 54 directed downwards and aftwards relative to the center 126 of the first annular zone 54. Generally, the fuel 110 could be injected in an axial direction, or in a direction that also incorporates radial and/or circumferential velocity components. For example, the fuel 110 could either be injected using a static fuel spray, or by slinging with an associated rotating shaft.

In both the second and third aspects, the first poloidal direction 132 is such that at least a portion of a mean flow 130' of the first poloidal flow 130 aft of the center 126 of the first annular zone 54 is directed in a radially inward direction 232.

In accordance with a fourth aspect, the operation of injecting the first portion of air 100 into the first annular zone 54 provides for enhanced mixing of the first combustion gas 140 with the fuel 110 within the first annular zone 54 of the annular combustor 52. For example, in one set of embodiments in accordance with the fourth aspect, the operation of injecting the first portion of air 100 into the first annular zone 54 comprises at least two of:

1) injecting at least a portion 100.1 of the first portion of air 100 at least partially radially outwards and at least partially forward from a radially inward boundary 214 of the first annular zone 54, for example, from the first inner surface 64 of the first annular zone 54, from a location 216 that is aftward of a forward boundary 218 of the first annular zone 54, for example, aftward of the forward surface 60 of the first annular zone 54, e.g. aftward of the region 176 of the first annular zone 54 of the annular combustor 52 within which fuel 110 in injected by the fuel slinger or injector 108;

2) injecting at least a portion 100.2 of the first portion of air 100 at least partially radially outwards from the forward boundary 218 of the first annular zone 54, for example from the forward surface 60 of the first annular zone 54, from a location 220 that is radially inward of the center 126 of the first annular zone 54;

3) injecting at least a portion 100.3 of the first portion of air 100 at least partially aftwards from the forward boundary 218 of the first annular zone 54 of the first annular zone 54, for example from the forward surface 60 of the first annular zone 54, from a location 222 that is radially outward of the center 126 of the first annular zone 54; or 4) injecting at least a portion 100.4 of the first portion of air 100 at least partially inwards from a radially outward boundary 224 of the first annular zone 54, for example, from the first outer surface 62 of the first annular zone 54, from a location 226 that is aftward of a center 126 of the first annular zone 54;

wherein at least two of the operations of injecting at least a portion of the first portion of air 100 are azimuthally offset or interleaved with respect to one another about the central axis 30 with respect to the first annular zone 54 of the annular combustor 52.

In accordance with a fifth aspect, a first portion 186.1 of effusion cooling air 186 is injected from at least one surface 64, 60, 62 of the annular combustor 52 bounding or surrounding the first annular zone 54 so as to provide for cooling the surface(s) 64, 60, 62 of the first annular zone 54 of the annular combustor 52 from which the first portion 186.1 of effusion cooling air 186 is injected.

Following ignition, the fuel 110 is at least partially combusted with the first portion of air 100 in the first poloidal flow 130 within the first annular zone 54 of the annular combustor 52 so as to produce a first combustion gas 140 that is eventually discharged into the annular transition zone 58 of the annular combustor 52. For example, in one embodiment, the mass ratio of fuel 110 to the air injected into the first annular zone 54 of the annular combustor 52 is in excess of, i.e. richer than, the lower flammability limit of the fuel 110 and the air within the first annular zone 54 and less than, i.e. leaner than, the upper flammability limit of the fuel 110 and the air within the first annular zone 54, wherein the air within the first annular zone 54 includes the first portion of air 100 injected into the first annular zone 54 and the portion of the first portion 186.1 of effusion cooling air 186 within the first annular zone 54 that is involved with combustion.

The method of operating a combustion system 10 further comprises inducing at least a partial second poloidal flow 142 of the second combustion gas 150 within the annular transition zone 58 of the annular combustor 52, wherein the second poloidal flow 142 is in a second poloidal direction 144 that is opposite to the first poloidal direction 132. For example, in accordance with a sixth aspect, the operation of inducing the at least a partial second poloidal flow 142 comprises deflecting the first combustion gas 140 discharged from the first annular zone 54 with a radially-outwardly-extending annular step 138 aft of the first annular zone 54. As another example, in accordance with a seventh aspect, which may be embodied alone or, as illustrated in FIGS. 11*a* and 11*b*, in combination with the sixth aspect, the operation of inducing the at least a partial second poloidal flow 142 comprises injecting the second portion of air 148 from and aft boundary 234 of the annular transition zone 58, for example, from the transitional inner surface 80, for example, from the radially-outwardly-extending annular step 138 thereof, in a direction that is at least partially forwards within the annular transition zone 58 of the annular combustor 52 from a location 236 that is radially outwards of the first inner surface 64 of the first annular zone 54 of the annular combustor 52.

The method of operating a combustion system 10 further comprises inducing at least a partial third poloidal flow 152 of the second combustion gas 150 within the annular transition zone 58 of the annular combustor 52, wherein the third poloidal flow 152 is in the first poloidal direction 132, i.e. opposite to the second poloidal direction 144. For example, in accordance with the sixth aspect, the operation of inducing the at least a partial third poloidal flow 152 comprises deflecting the second combustion gas 150 within the annular transition zone 58 with a radially-inwardly-extending annular step 238, —for example, constituting a portion of the transitional outer surface 78, —aft of the first annular zone 54 and forward of the aft boundary 234 of the annular transition zone 58, and at a location 240 that is radially outward of the first annular zone 54. As another example, in accordance with the seventh aspect, the operation of inducing the at least a partial third poloidal flow 152 comprises injecting a third portion of air 158 at least partially aftwards from a forward boundary 242 of the annular transition zone 58, for example, from the transitional outer surface 78, for example, from the radially-inwardly-extending annular step 238 thereof, from a location 244 that is radially inward of a radially outermost boundary 246 of the annular transition zone 58, for example, from a location 244 that is radially inward of the transitional outer surface 78 of the annular transition zone 58.

The first combustion gas 140 is transformed to a second combustion gas 150 within the annular transition zone 58 of the annular combustor 52, either by further combustion therein of the first combustion gas 140, i.e. of the fuel 110 with the air from the first annular zone 54, or by mixing and/or combustion with additional air injected into the annular transition zone 58, for example, by mixing and/or combustion with a second portion of air 148 injected from the transitional inner surface 80 in a direction that is at least partially forwards within the annular transition zone 58 of the annular combustor 52 from the location 236 that is radially outwards of the first inner surface 64 of the first annular zone 54 of the annular combustor 52, mixing and/or combustion with a third portion of air 158 injected from the transitional outer surface 78 in a direction that is at least partially aftwards within the annular transition zone 58 of the annular combustor 52 from the location 244 that is radially inward of the transitional outer surface 78 of the annular transition zone 58 of the annular combustor 52, or by mixing and/or combustion with a second portion 186.2 of effusion cooling air 186 injected into the annular transition zone 58 in accordance with the fifth aspect from at least one surface 78, 80 of the annular transition zone 58 of the annular combustor 52. For example, the second portion 186.2 of effusion cooling air 186 may be injected from either the transitional outer surface 78 or the transitional inner surface 80 of the annular transition zone 58 of the annular combustor 52, or both, so as to provide for cooling the surface(s) 78, 80 of the annular transition zone 58 of the annular combustor 52 from which the second portion 186.2 of effusion cooling air 186 is injected. For example, in one embodiment, the amount of air in the second portion of air 148 and the second portion 186.2 of effusion cooling air 186 injected into the annular transition zone 58 is adapted so that the second combustion gas 150 provides for stoichiometric or leaner combustion of the fuel 110. In another embodiment, the amount of air in the second portion of air 148 and the second portion 186.2 of effusion cooling air 186 injected into the annular transition zone 58 is adapted so that the second combustion gas 150 is richer than stoichiometric, for example, so as to provide fuel 110 for a downstream combustion element, for example, when the combustion system 10 is used as a preburner for a gas generator.

The second combustion gas 150 is discharged from the annular transition zone 58 of the annular combustor 52 into the second annular zone 56 of the annular combustor 52. The second combustion gas 150 is transformed to a third combustion gas 160 within the second annular zone 56 of the annular combustor 52 either by further combustion therein of the second combustion gas 150, or by mixing and/or combustion with additional air injected into the second annular zone 56, for example, by mixing and/or combustion with a fourth portion of air 166 injected from the second inner surface 72 in a direction that is radially outwards within the second annular zone 56 of the annular combustor 52 from a location 248 that is just aft of the radially-outwardly-extending annular step 138, or by mixing and/or combustion with a third portion 186.3 of effusion cooling air 186 injected into the second annular zone 56 in accordance with the fifth aspect from at least one surface 70, 72 of the second annular zone 56 of the annular combustor 52, for example from either the second outer surface 70 or the second inner surface 72 of the second annular zone 56 of the annular combustor 52, so as to provide for cooling the surface(s) 70, 72 of the second annular zone 56 of the annular combustor 52 from which the third portion 186.3 of effusion cooling air 186 is injected. For example, in one embodiment, the amount of air in the fourth portion of air 166 and the third portion 186.3 of effusion cooling air 186 injected into the second annular zone 56 is adapted so that the third combustion gas 160 is diluted so as to be substantially leaner than stoichiometric. In another embodiment, the amount of air in the fourth portion of air 166 and the third portion 186.3 of effusion cooling air 186 injected into the second annular zone 56 is adapted so that the third combustion gas 160 richer than stoichiometric, for example, so as to provide fuel 110 for a downstream combustion element, for example, when the combustion system 10 is used as a preburner for a gas generator.

In accordance with an eighth aspect, at least one radial strut or vane 90 is oriented, for example, radially canted, so as to introduce a circumferential component of swirl to the flow of the portion 100.1 of the first portion of air 100 flowing within the first inner annular plenum 96, which results in a corresponding circumferential component of flow of the portion 100.1 of the first portion of air 100 when injected into the first annular zone 54 of the annular combustor 52, which provides for inducing a toroidal helical flow 134 of the first portion of air 100 within the first annular zone 54 of the annular combustor 52. Alternatively or additionally, the angular momentum of fuel 110 injected from a rotating fuel slinger or injector 108 can either provide for or contribute to the circumferential component of the toroidal helical flow 134.

The method of operating a combustion system 10 further comprises generating a back pressure 207 within the annular combustor 52 responsive to the operation of discharging the third combustion gas 160 therefrom. For example, in one embodiment, the operation of generating the back pressure 207 within the annular combustor 52 comprises discharging the third combustion gas 160 through a nozzle 202, and in another embodiment, the operation of generating the back pressure 207 within the annular combustor 52 comprises discharging the third combustion gas 160 through a heat exchanger 252. The back pressure 207 within the annular combustor 52 which provides for limiting the associated velocities of air through the associated orifices 114, 120, 124, 128, 146, 156, 164, 172, 180, so as to thereby provide for sustaining the associated flame within the annular combustor 52 following ignition, which flame would otherwise could be extinguished if the flows of air through the associated orifices 114, 120, 124, 128, 146, 156, 164, 172, 180 were at corresponding sufficiently high velocities. As the back pressure 207 is increased, the residence time of the first 140, second 150 and third 160 combustion gases increases, thereby increasing the amount of time that the associated fuel/air mixture 210 and initial combustion products remain in the primary combustion zone 213, thereby increasing the likelihood for complete combustion and increasing the efficiency of the associated combustion process.

The efficiency of the annular diffuser 32, —i.e. the ratio given by the difference in pressure between the static pressure at the outlet 32.2 and the static pressure at the inlet 32.1 divided by the difference between the total pressure at the inlet 32.1 and the static pressure at the inlet 32.1, —is dependent upon a number of factors, including: the area ratio, i.e. the ratio of the area at the inlet 32.1 to the area at the outlet 32.2; the ratio of length to width of the annular diffuser 32; the divergence angle, i.e. the difference in angle between the outer 36 and inner 34 generalized conical surfaces; the Reynolds number at the inlet 32.1; the Mach number at the inlet 32.1; the inlet boundary layer blockage factor; the inlet turbulence intensity; and the inlet swirl. By incorporating the radially-inwardly-extending annular step 238 and the associated annular transition zone 58, the combustion system 10 enables the associated annular diffuser 32 to be substantially longer than would otherwise be possible, and provides for greater control over the associated area ratio, which together provides for increasing the efficiency of the annular diffuser 32 than would otherwise be possible. For example, the radially-inwardly-extending annular step 238 provides for increasing the radius at the outlet 32.2 of the annular diffuser 32 than would otherwise be possible. The efficiency of the annular diffuser 32, —i.e. the ratio given by the difference in pressure between the pressure at the outlet 32.2 to the pressure at the inlet 32.1 divided by the difference between the static pressure at the inlet 32.1 and the pressure at the inlet 32.1, —is dependent upon a number of factors, including: the area ratio, i.e. the ratio of the area at the inlet 32.1 to the area at the outlet 32.2; the ratio of length to width of the annular diffuser 32; the divergence angle, i.e. the difference in angle between the outer 36 and inner 34 generalized conical surfaces; the Reynolds number at the inlet 32.1; the Mach number at the inlet 32.1; the inlet boundary layer blockage factor; the inlet turbulence intensity; and the inlet swirl. By incorporating the radially-inwardly-extending annular step 238 and the associated annular transition zone 58, the combustion system 10 enables the associated annular diffuser 32 to be substantially longer than would otherwise be possible, and provides for greater control over the associated area ratio, which together provides for increasing the efficiency of the annular diffuser 32 than would otherwise be possible. For example, the radially-inwardly-extending annular step 238 provides for increasing the radius at the outlet 32.2 of the annular diffuser 32 than would otherwise be possible.

The combustion system 10 has a variety applications, including, but not limited to, a combustor of a gas turbine engine; in cooperation with a heat exchanger, for example, as an associated source of heat; a preheater or vitiator for a test engine; a power source for an auxiliary power unit; and a power source for a turbo-pump of a liquid propellant rocket engine.

While specific embodiments have been described in detail in the foregoing detailed description and illustrated in the accompanying drawings, those with ordinary skill in the art will appreciate that various modifications and alternatives to those details could be developed in light of the overall teachings of the disclosure. It should be understood, that any reference herein to the term "or" is intended to mean an "inclusive or" or what is also known as a "logical OR", wherein the expression "A or B" is true if either A or B is true, or if both A and B are true. Furthermore, it should also be understood that unless indicated otherwise or unless physically impossible, that the above-described embodiments and aspects can be used in combination with one another and are not mutually exclusive. Accordingly, the particular arrangements disclosed are meant to be illustrative only and not limiting as to the scope of the invention, which is to be given the full breadth of the appended claims, and any and all equivalents thereof.

What is claimed is:

1. A combustion system, comprising:

a. an annular combustor, comprising:

i. a first annular zone, wherein said first annular zone is bounded by a forward surface, a first outer surface, and a first inner surface, a radial dimension of said first outer surface exceeds a corresponding radial dimension of said first inner surface over said first annular zone relative to a central axis of said annular combustor, said first inner surface incorporates at least one first orifice adapted to inject at least a first portion of a first portion of air into said first annular zone, said at least one first orifice is oriented so as to provide for injecting said first portion of said first portion of air forward and radially outwards within said first annular zone of said annular combustor, and said first portion of said first portion of air when injected from said at least one first orifice provides for inducing a first poloidal flow in a first poloidal direction within said first annular zone;

ii. a second annular zone, wherein said second annular zone is aft of said first annular zone, said second annular zone is bounded by a second outer surface and a second inner surface, and a radial dimension of said second outer surface exceeds a corresponding radial dimension of said second inner surface over said second annular zone relative to said central axis of said annular combustor; and iii. an annular transition zone, wherein said annular transition zone is between said first annular zone and said second annular zone, said annular transition zone is bounded by a transitional outer surface and a transitional inner surface, said transitional outer surface provides for coupling said first outer surface to said second outer surface, a radial dimension of said transitional outer surface at said second outer surface exceeds a corresponding radial dimension of said transitional outer surface at said first outer surface, said transitional inner surface provides for coupling said first inner surface to said second inner surface, a radial dimension of said transitional inner surface at said second inner surface exceeds a corresponding radial dimension of said transitional inner surface at said first inner surface, said second inner surface of said second annular zone is stepped radially-outwards relative to said first inner surface of said first annular zone, said second outer surface of said second annular zone is stepped radially-outwards relative to said first outer surface of said first annular zone, said transitional inner surface provides for inducing an at least partial second poloidal flow in a second poloidal direction within said annular transition zone downstream of said first poloidal flow, and said transitional outer surface provides for inducing an at least partial third poloidal flow in said first poloidal direction within said annular transition zone downstream of said second poloidal flow, wherein said second poloidal direction is opposite to said first poloidal direction; and b. a fuel slinger or injector located forward of said at least one first orifice and adapted to sling or inject fuel into said first annular zone of said annular combustor.

2. A combustion system as recited in claim 1, further comprising at least one of: at least one second orifice, at least one third orifice or at least one fourth orifice, wherein said at least one second orifice, said at least one third orifice and said at least one fourth orifice are adapted to inject a remaining portion of said first portion of air into said first annular zone of said annular combustor, said at least one second orifice is located on and extends through said forward surface and is oriented so as to provide for injecting a second portion of said first portion of air at least partially radially outwards within said first annular zone of said annular combustor, said at least one second orifice is located forward of said fuel slinger or injector, said at least one third orifice is located on and extends through said forward surface radially outwards of a center of said first annular zone and is oriented so as to provide for injecting a third portion of said first portion of air at least partially aftwards within said first annular zone of said annular combustor, said at least one fourth orifice is located on and extends through said first outer surface aft of said center of said first annular zone and is oriented so as to provide for injecting a fourth portion of said first portion of air at least partially radially inwards within said first annular zone of said annular combustor, and each of said at least one second orifice, said at least one third orifice and said at least one fourth orifice is located or oriented so to provide for further inducing said first poloidal flow in said first poloidal direction within said first annular zone.

3. A combustion system as recited in claim 2, wherein said at least one first orifice is azimuthally offset with respect to said at least one second orifice.

4. A combustion system as recited in claim 2, wherein said at least one first orifice is substantially azimuthally aligned with respect to said at least one third orifice and with respect to said at least one fourth orifice.

5. A combustion system as recited in claim 2, further comprising:

a. an annular manifold plenum adjacent to said transitional outer surface, wherein said annular manifold plenum provides for supplying said first portion of air; and b. a forward annular plenum adjacent to said forward surface, wherein said forward annular plenum is in fluid communication with said annular manifold plenum and provides for respectively supplying said second and third portions of said first portion of air to either or both said at least one second orifice or said at least one third orifice.

6. A combustion system as recited in claim 5, further comprising a first set of effusion cooling orifices on and through said forward surface, wherein said first set of effusion cooling orifices are adapted to receive said air from said forward annular plenum and are adapted to provide for effusion cooling of said forward surface.

7. A combustion system as recited in claim 2, further comprising a first outer annular plenum adjacent to said first outer surface, wherein said first outer annular plenum is in fluid communication with an annular manifold plenum adjacent to said transitional outer surface plenum and provides for supplying said fourth portion of said first portion of air received from said annular manifold plenum to said at least one fourth orifice.

8. A combustion system as recited in claim 7, further comprising a second set of effusion cooling orifices on and through said first outer surface, wherein said second set of effusion cooling orifices are adapted to receive said air from said first outer annular plenum and are adapted to provide for effusion cooling of said first outer surface.

9. A combustion system as recited in claim 2, further comprising at least one fifth orifice located on and extending through said transitional inner surface and oriented so as to provide for injecting a second portion of said air at least partially forwards within said annular transition zone of said annular combustor.

10. A combustion system as recited in claim 9, further comprising:

a. an annular manifold plenum adjacent to said transitional outer surface, wherein said annular manifold plenum provides for supplying said second portion of said air; and b. a second inner annular plenum adjacent to said transitional inner surface and adjacent to said second inner surface, wherein said second inner annular plenum is in fluid communication with said annular manifold plenum and provides for supplying said second portion of said air to said at least one fifth orifice.

11. A combustion system as recited in claim 10, further comprising at least one radial strut or vane aft of said annular combustor, wherein said second inner annular plenum is in fluid communication with said annular manifold plenum through a hollow interior of said at least one radial strut or vane.

12. A combustion system as recited in claim 10, further comprising a fourth set of effusion cooling orifices on and through said transitional inner surface, wherein said fourth set of effusion cooling orifices are adapted to receive said air from said second inner annular plenum and are adapted to provide for effusion cooling of said transitional inner surface.

13. A combustion system as recited in claim 2, further comprising at least one sixth orifice located on and extending through said transitional outer surface and oriented so as to provide for injecting a third portion of said air at least partially aftwards within said annular transition zone of said annular combustor.

14. A combustion system as recited in claim 13, wherein said at least one sixth orifice is azimuthally offset relative to said at least one first orifice.

15. A combustion system as recited in claim 13, further comprising an annular manifold plenum adjacent to said transitional outer surface, wherein said annular manifold plenum provides for supplying said third portion of said air.

16. A combustion system as recited in claim 15, further comprising a fifth set of effusion cooling orifices on and through said transitional outer surface, wherein said fifth set of effusion cooling orifices are adapted to receive said air from said annular manifold plenum and are adapted to provide for effusion cooling of said transitional outer surface.

17. A combustion system as recited in claim 2, further comprising at least one radial strut or vane aft of said annular combustor, wherein said at least one first orifice is azimuthally offset with respect to said at least one radial strut or vane.

18. A combustion system as recited in claim 17, further comprising a nozzle aft of or defined by said at least one radial strut or vane.

19. A combustion system as recited in claim 1, further comprising an annular manifold plenum adjacent to said transitional outer surface, wherein said annular manifold plenum provides for supplying said first portion of air.

20. A combustion system as recited in claim 19, further comprising a first inner annular plenum adjacent to said first inner surface, wherein said first inner annular plenum is in fluid communication with said annular manifold plenum and provides for supplying said first portion of said first portion of air to said at least one first orifice.

21. A combustion system as recited in claim 20, further comprising at least one radial strut or vane aft of said annular combustor, wherein said first inner annular plenum is in fluid communication with said annular manifold plenum through a hollow interior of said at least one radial strut or vane.

22. A combustion system as recited in claim 21, wherein said at least one radial strut or vane is radially canted so as to provide for introducing a circumferential component of swirl to the flow of said first portion of said first portion of air exiting therefrom.

23. A combustion system as recited in claim 20, further comprising a third set of effusion cooling orifices on and through at least one of said first inner surface or said transitional inner surface, wherein said third set of effusion cooling orifices are adapted to receive said air from said first inner annular plenum and are adapted to provide for effusion cooling of either or both said first inner surface or said transitional inner surface.

24. A combustion system as recited in claim 19, further comprising:

a. a second outer annular plenum adjacent to said second outer surface, wherein said second outer annular plenum is in fluid communication with said annular manifold plenum; and b. a seventh set of effusion cooling orifices on and through said second outer surface, wherein said seventh set of effusion cooling orifices are adapted to receive said air from said second outer annular plenum and are adapted to provide for effusion cooling of said second outer surface.

25. A combustion system as recited in claim 19, further comprising an annular diffuser adapted to provide for diffusing incoming said air from a compressor of said combustion system, and to provide diffused said air to said annular manifold plenum.

26. A combustion system as recited in claim 1, further comprising at least one seventh orifice located on and extending through said second inner surface and oriented so as to provide for injecting a fourth portion of said air radially outwards within said second annular zone of said annular combustor.

27. A combustion system as recited in claim 26, further comprising:

a. a second inner annular plenum adjacent to said second inner surface, wherein said second inner annular plenum is in fluid communication with an annular manifold plenum adjacent to said transitional outer surface, and said second inner annular plenum provides for supplying said fourth portion of said air received from said annular manifold plenum to said at least one seventh orifice; and b. a sixth set of effusion cooling orifices on and through said second inner surface, wherein said sixth set of effusion cooling orifices are adapted to receive said air from said second inner annular plenum and are adapted to provide for effusion cooling of said second inner surface.

28. A combustion system as recited in claim 1, further comprising at least one eighth orifice located on and extending through said forward surface proximate to said fuel slinger or injector so as to provide for injecting a fifth portion of said air within a region of said first annular zone within which fuel is injected by said fuel slinger or injector.

29. A combustion system as recited in claim 1, further comprising at least one ninth orifice located on and extending through said first inner surface proximate to said fuel slinger or injector so as to provide for injecting a sixth portion of said air within a region of said first annular zone within which fuel is injected by said fuel slinger or injector.

30. A combustion system as recited in claim 1, wherein said fuel slinger or injector is operatively coupled to a central rotatable shaft.

31. A combustion system as recited in claim 1, further comprising:

a. an annular manifold plenum adjacent to said transitional outer surface;

b. at least one radial strut or vane aft of said annular combustor;

c. a second inner annular plenum adjacent to said transitional inner surface and adjacent to said second inner surface; and d. at least one fifth orifice located on and extending through said transitional inner surface and oriented so as to provide for injecting a second portion of said air at least partially forwards within said annular transition zone of said annular combustor, wherein said second inner annular plenum is in fluid communication with said annular manifold plenum through a hollow interior of said at least one radial strut or vane, said annular manifold plenum provides for supplying said second portion of said air to said second inner annular plenum through said at least one radial strut or vane, and said at least one radial strut or vane is radially canted so as to provide for introducing a circumferential component of swirl to the flow of said second portion of said air exiting therefrom.

32. A combustion system as recited in claim 1, wherein said radial dimension of said first inner surface is substantially uniform, and said radial dimension of said second outer surface is substantially uniform.

* * * * *

UNITED STATES PATENT AND TRADEMARK OFFICE

CERTIFICATE OF CORRECTION

PATENT NO. : 9,328,924 B2
APPLICATION NO. : 14/148695
DATED : May 3, 2016
INVENTOR(S) : Jamey J. Condevaux et al.

It is certified that error appears in the above-identified patent and that said Letters Patent is hereby corrected as shown below:

On the Title Page

Page 2, References Cited, U.S. PATENT DOCUMENTS:

U.S. Patent No. 3,182,453: "Probert" should be changed to --Probert et al.--;
U.S. Patent No. 5,307,637: "Stickles" should be changed to --Stickles et al.--;
U.S. Publication No. 2007/0193248: "Bessagnet" should be changed to --Bessagnet et al.--; and
U.S. Publication No. 2007/0234733: "Harris" should be changed to --Harris et al.--.

Page 2, References Cited, OTHER PUBLICATIONS:

--International Search Report and Written Opinion of the International Searching Authority in International Application No. PCT/US2010/025073, 15 October 2012, 12 pages.-- should be added.

In the Claims

Column 16, Claim 2, Line 50,

"so to" should be changed to --so as to--.

Signed and Sealed this
Twenty-first Day of June, 2016

Michelle K. Lee

Michelle K. Lee
*Director of the United States Patent and Trademark Office*